US010512330B2

(12) United States Patent
Jorbel

(10) Patent No.: US 10,512,330 B2
(45) Date of Patent: Dec. 24, 2019

(54) FURNITURE MEMBER WITH COMPLIANT LEGREST MECHANISM

(71) Applicant: La-Z-Boy Incorporated, Monroe, MI (US)

(72) Inventor: Scott Jorbel, Chattanooga, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 177 days.

(21) Appl. No.: 15/793,305

(22) Filed: Oct. 25, 2017

(65) Prior Publication Data

US 2019/0116978 A1 Apr. 25, 2019

(51) Int. Cl.

| | |
|---|---|
| ***A47C 1/024*** | (2006.01) |
| ***A47C 1/034*** | (2006.01) |
| ***A47C 1/032*** | (2006.01) |
| ***A47C 1/035*** | (2006.01) |
| ***A47C 1/0355*** | (2013.01) |

(52) U.S. Cl.

CPC ..... *A47C 1/024* (2013.01); *A47C 1/0342* (2013.01); *A47C 1/0352* (2013.01); *A47C 1/0355* (2013.01); *A47C 1/03294* (2013.01)

(58) Field of Classification Search

CPC ... A47C 1/024; A47C 1/03294; A47C 1/0342; A47C 1/0352; A47C 1/0355; A47C 1/02; A47C 1/022; A47C 1/031; A47C 1/034; A47C 1/0347

USPC ..... 297/51, 46, 52, 55, 83, 84, 85 R, 85 M, 297/85 L, 86

See application file for complete search history.

(56) References Cited

U.S. PATENT DOCUMENTS

| | | | | |
|---|---|---|---|---|
| 3,550,952 A | | 12/1970 | Ferguson | |
| 3,767,257 A | * | 10/1973 | Rogers, Jr. | A47C 1/0345 297/85 L |
| 3,850,475 A | * | 11/1974 | Katz | A47C 1/0355 297/85 L |
| 5,480,209 A | * | 1/1996 | May | A47C 1/0352 297/83 |
| 5,772,278 A | * | 6/1998 | Kowalski | A47C 1/0355 297/85 L |
| 7,261,367 B2 | | 8/2007 | Duncan et al. | |

* cited by examiner

*Primary Examiner* — Mark R Wendell

(74) *Attorney, Agent, or Firm* — Harness, Dickey & Pierce, P.L.C.

(57) ABSTRACT

A legrest mechanism including a seat base rail, a mechanism rail, a drive assembly, a pivot plate link, a pivot plate, a main drive link, and a parallelogram legrest link assembly. The drive assembly moves the mechanism rail relative to the seat base rail, which drives movement of the parallelogram legrest link assembly between a retracted position and an extended position. The parallelogram legrest link assembly includes first and second legrest links, footrest and legrest drive arms, and a legrest bracket. The main drive link has a pin that is slidingly received in a slot in one of the first legrest link, second legrest link, or main drive link such that movement of the parallelogram legrest link assembly is decoupled from movement of the main drive link when the legrest and/or parallelogram legrest link assembly encounters an obstruction while moving from the extended position to the retracted position.

22 Claims, 13 Drawing Sheets

FURNITURE MEMBER WITH COMPLIANT LEGREST MECHANISM

FIELD

The subject disclosure generally relates to furniture and more specifically to legrest mechanisms used in reclining furniture.

BACKGROUND

This section provides background information related to the present disclosure and is not necessarily prior art.

Reclining furniture typically comprises a furniture member that includes a seat base, a seat back positioned adjacent to and extending away from a rearward end of the seat base, and a legrest adjacent to a forward end of the seat base. The furniture member may be a reclining chair, a reclining sofa, or other piece of reclining furniture. The seat back of such furniture members is typically configured to pivot or tilt relative to the seat base between an upright position and a reclined position. The legrest of such furniture members is typically configured to move relative to the seat base between a retracted position and an extended position. The tilting of the seat back and movement of the legrest is typically actuated either manually (e.g. by one or more levers) or by a powered mechanism (e.g. an electrically powered linear actuator). Movement of the legrest may occur independently of the tilting of the seat back, or alternatively, movement of the legrest may occur concurrently with the tilting of the seat back.

The legrest of reclining furniture members is typically supported by a pair of pantograph or scissor legrest mechanisms that include a number of linkages. These linkages allow the legrest to fold away under the seat base when the legrest is moved from the extended position to the retracted position.

SUMMARY

This section provides a general summary of the disclosure, and is not a comprehensive disclosure of its full scope or all of its features.

The subject disclosure provides for a furniture member having a legrest mechanism. The furniture member includes a seat base, a seat back, and a legrest. The seat base of the furniture member has a forward seat base end, a rearward seat base end, and a pair of seat base sides that extend between the forward seat base end and the rearward seat base end. The seat back of the furniture member is positioned adjacent to and extends away from the rearward seat base end. In operation, the seat back pivots relative to the seat base between an upright position and a reclined position. The legrest of the furniture member is positioned adjacent to the forward seat base end. In operation, the legrest moves relative to the seat base between a retracted position and an extended position. A pair of legrest mechanisms are mounted to the pair of seat base sides. Each legrest mechanism includes a seat base rail, a mechanism rail, a drive assembly, a pivot plate link, a pivot plate, a main drive link, and a parallelogram legrest link assembly. The drive assembly is pivotally connected to the seat base rail and the mechanism rail. In operation, the drive assembly drives motion of the mechanism rail relative to the seat base rail. The pivot plate link is pivotally connected to the seat base rail and the pivot plate is pivotally connected to the mechanism rail and the pivot plate link. The main drive link is pivotally connected to the pivot plate. Finally, the parallelogram legrest link assembly is pivotally connected to the seat base rail and the main drive link. In operation, the parallelogram legrest link assembly moves between the retracted position and the extended position in response to relative movement between the mechanism rail and the seat base rail.

The parallelogram legrest link assembly includes a first legrest link, a second legrest link, a footrest drive arm, a legrest drive arm, and a legrest bracket. The first legrest link extends between and is pivotally connected to the seat base rail and the footrest drive arm. The second legrest link extends between and is pivotally connected to the seat base rail and the legrest drive arm. The footrest drive arm extends between and is pivotally connected to the first legrest link and the legrest bracket. The legrest drive arm extends between and is pivotally connected to the second legrest link and the legrest bracket. One of the first legrest link, the second legrest link, or the main drive link has a first slot. The main drive link has a main drive link pin that is slidingly received in the first slot, which decouples the movement of the parallelogram legrest link assembly from the movement of the main drive link when the parallelogram legrest link assembly encounters an obstruction as the parallelogram legrest link assembly moves from the extended position to the retracted position. Advantageously, this arrangement solves the problem associated with objects obstructing the parallelogram legrest link assembly as the parallelogram legrest link assembly moves from the extended position to the retracted position. The advantages provided by this design are particularly beneficial when the parallelogram legrest link assembly is actuated by a powered drive assembly due to the higher forces that such powered drive assemblies are capable of exerting on the parallelogram legrest link assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1A:
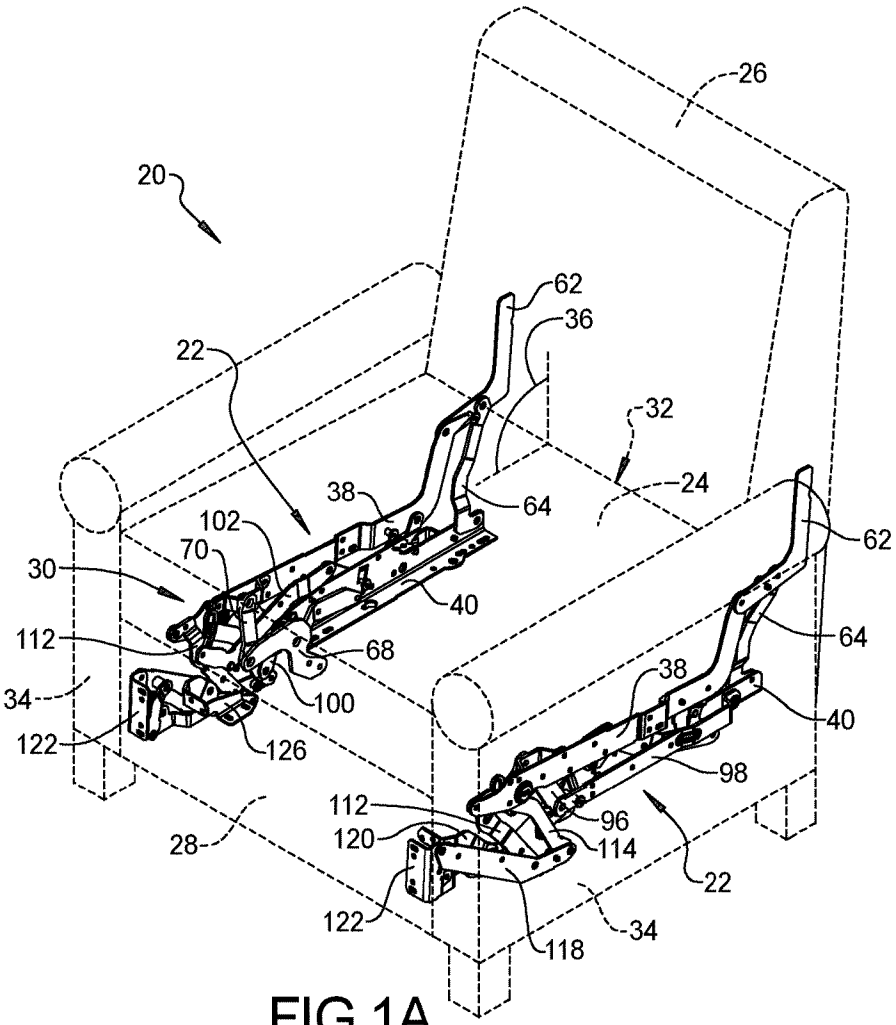
FIG. 1A is a front perspective view of an exemplary furniture member constructed in accordance with the subject disclosure having a legrest shown in a retracted position.

Referring to the Figures, wherein like numerals indicate corresponding parts throughout the several views, a furniture member 20 with one or more legrest mechanisms 22, 22' are shown.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1B:
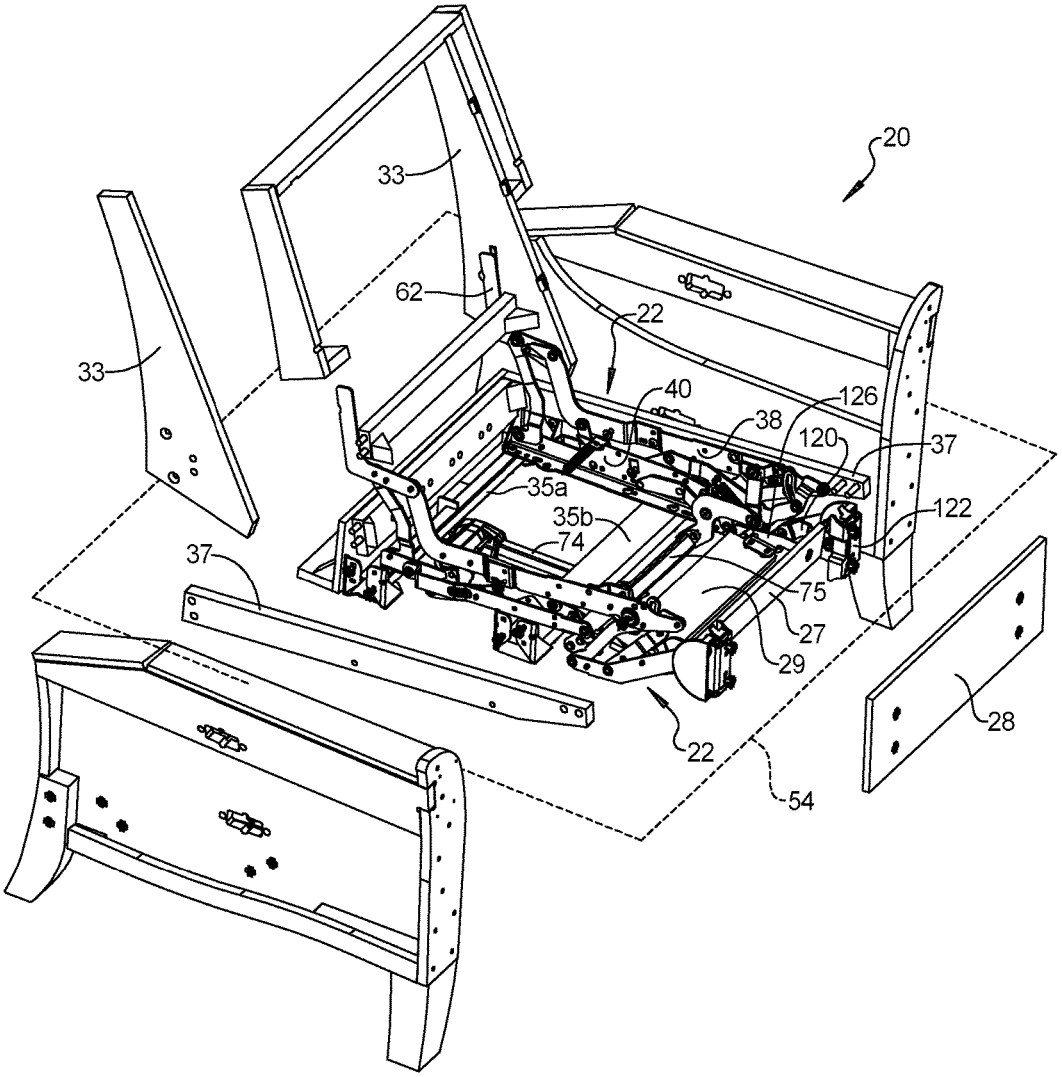
FIG. 1B is a front perspective exploded view of the exemplary furniture member illustrated in FIG. 1A having a legrest shown in a retracted position.
Figure 2:
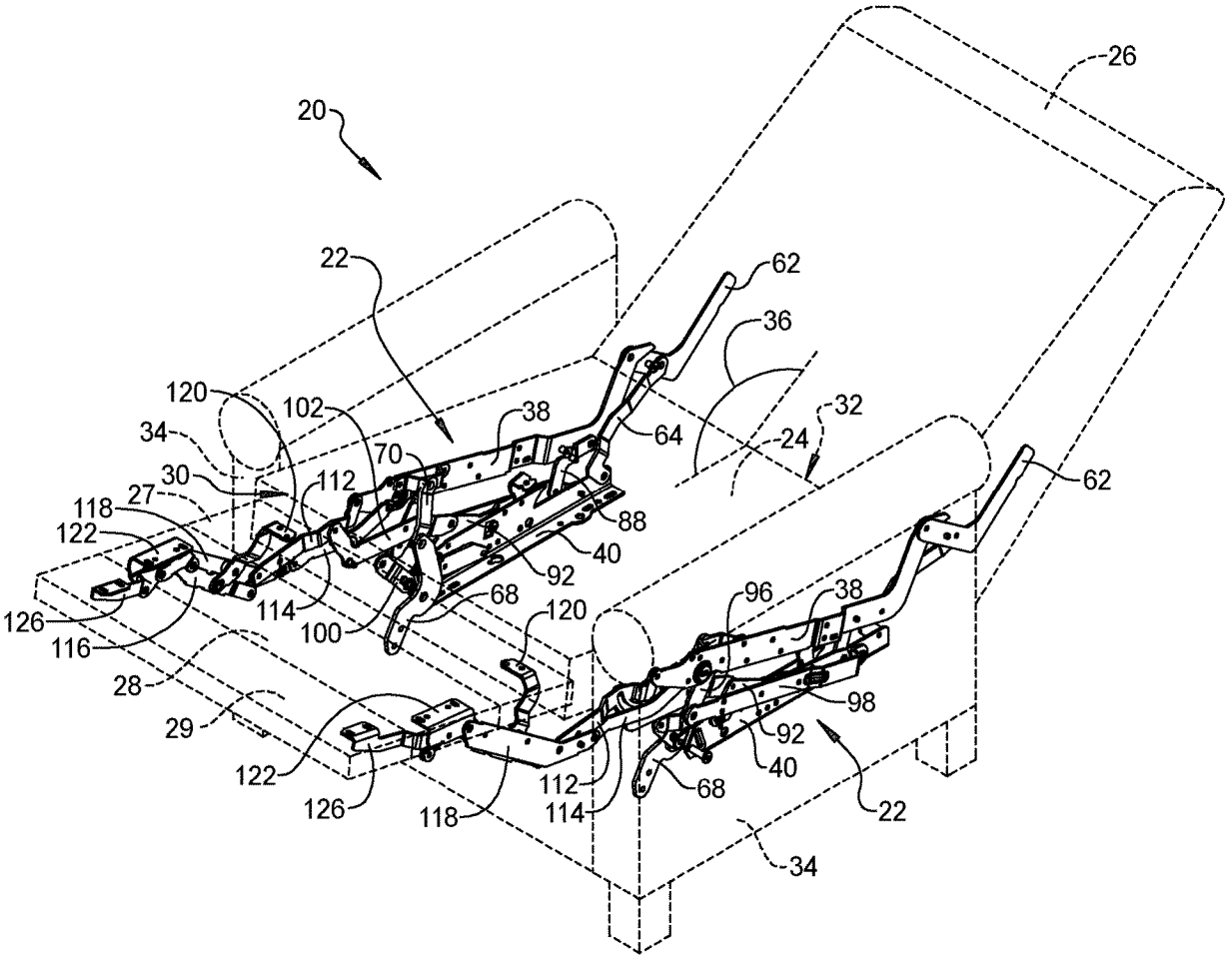
FIG. 2 is a front perspective view of the exemplary furniture member illustrated in FIG. 1A where the legrest is shown in an extended position.
Figure 3:
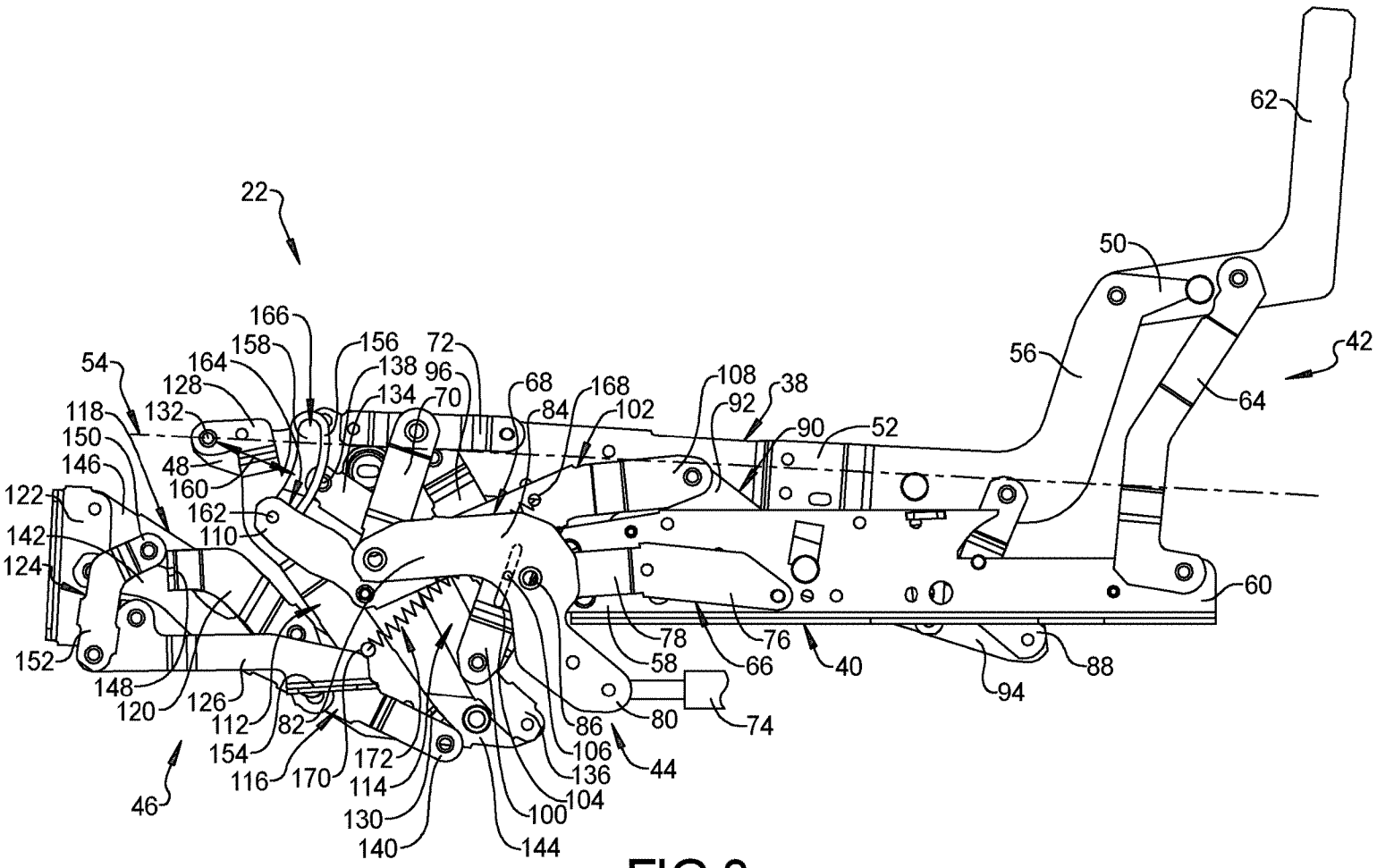
FIG. 3 is a side elevation view of an exemplary legrest mechanism constructed in accordance with the subject disclosure where the legrest mechanism is shown in the retracted position.
Figure 4:
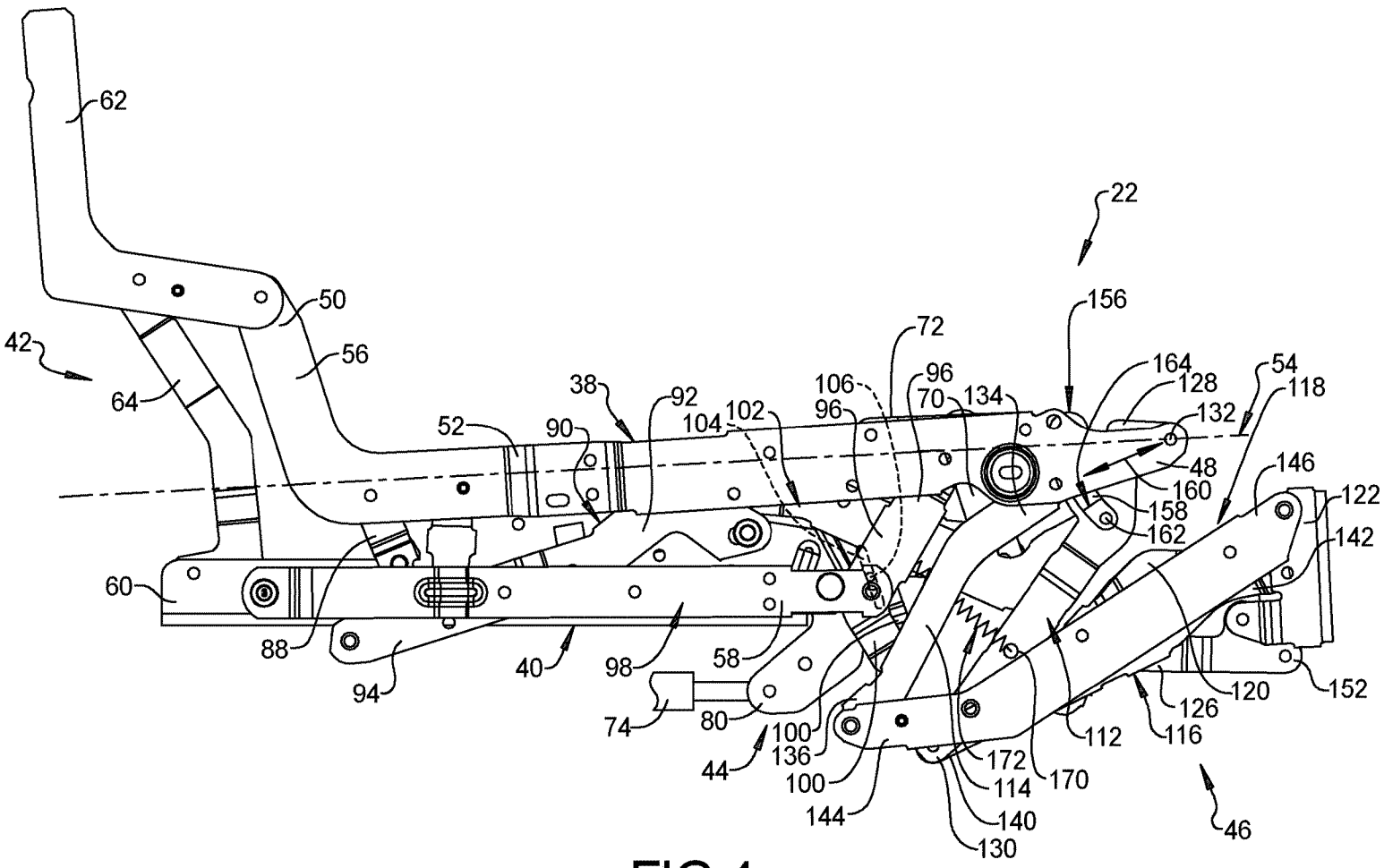
FIG. 4 is a side elevation view of the exemplary legrest mechanism illustrated in FIG. 3 where an opposite side of the legrest mechanism is shown in the retracted position.
Figure 5:
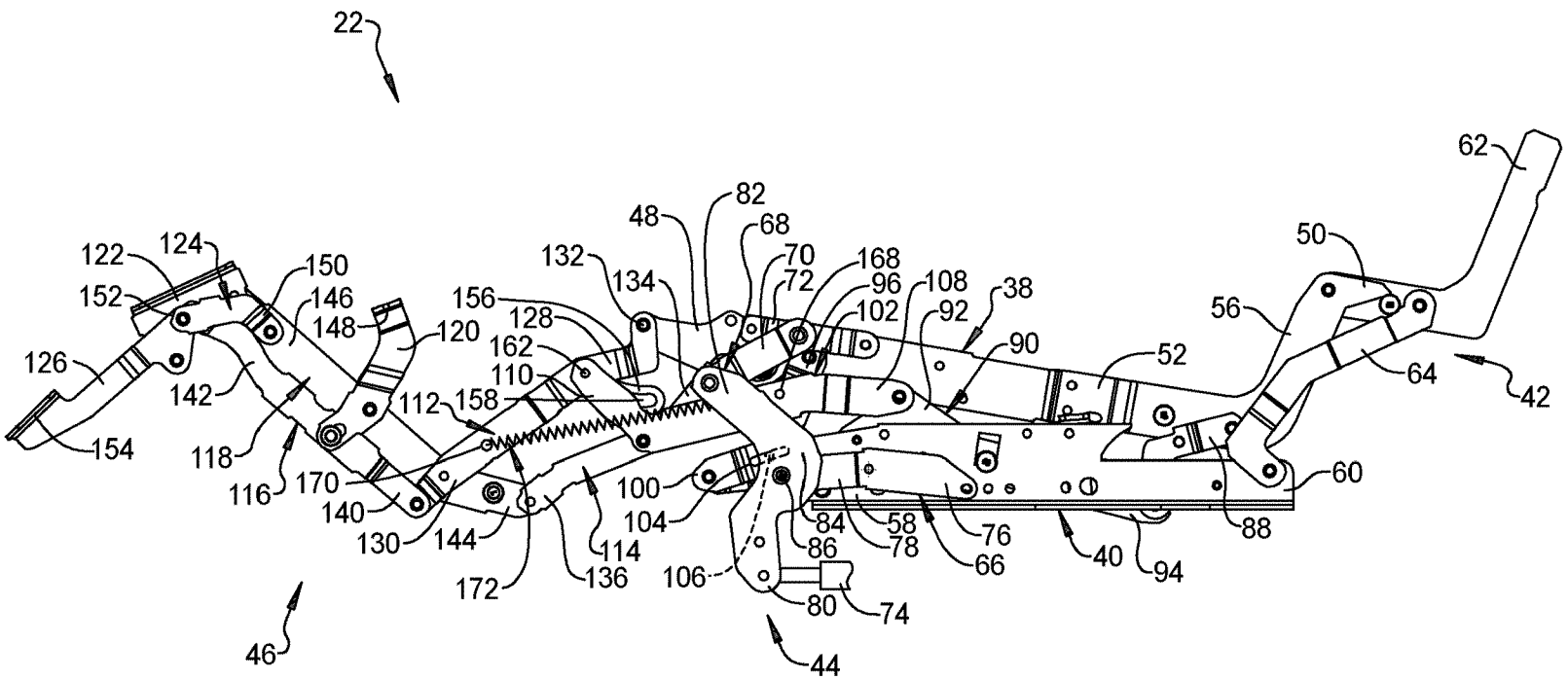
FIG. 5 is a side elevation view of the exemplary legrest mechanism illustrated in FIG. 3 where the legrest mechanism is shown moving between the retracted position and the extended position.
Figure 6:
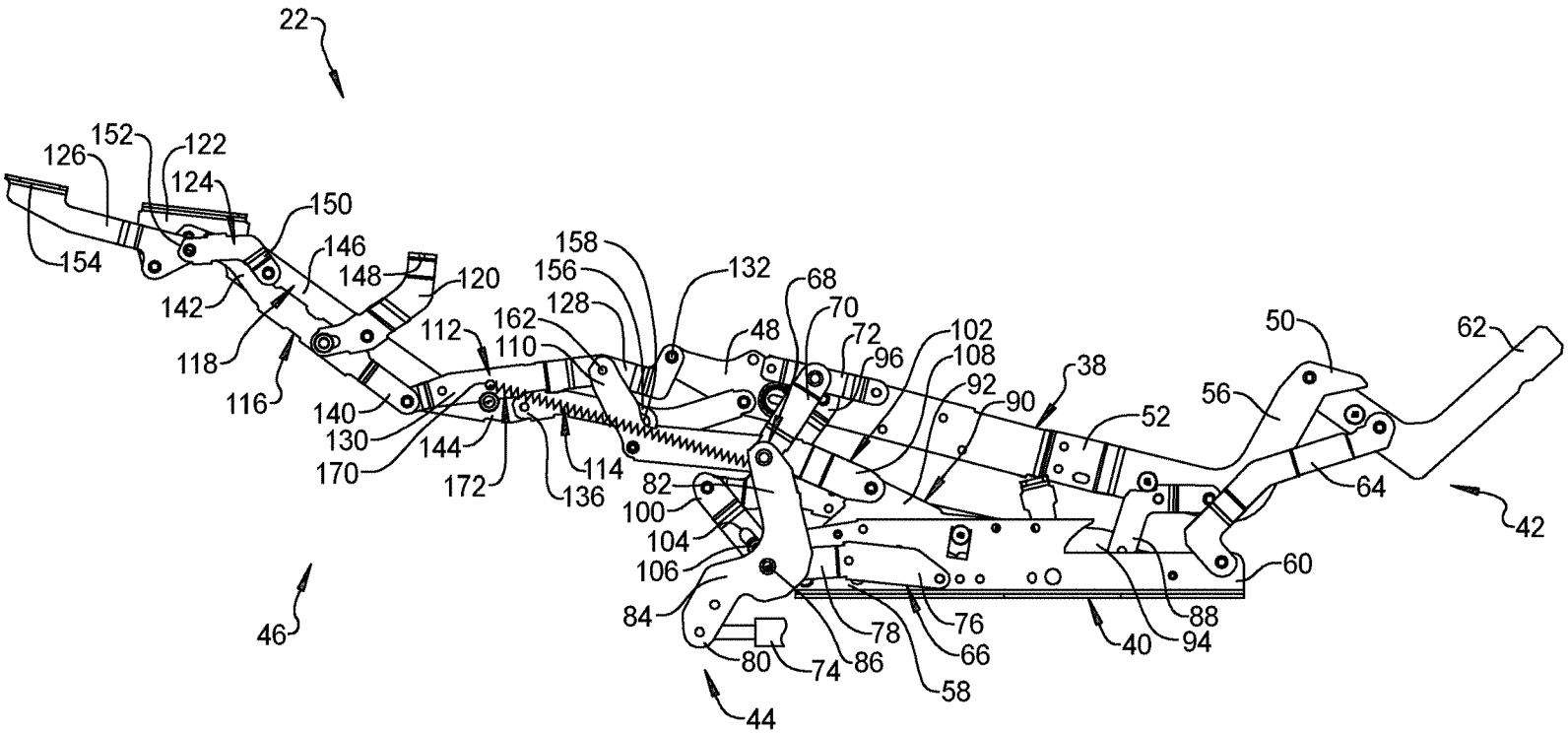
FIG. 6 is a side elevation view of the exemplary legrest mechanism illustrated in FIG. 3 where the legrest mechanism is shown in the extended position.

The furniture member 20 illustrated in FIGS. 1A, 1B, and 2 is shown in the form of a reclining chair. It should be appreciated that this is only one exemplary form of the furniture member 20 and that the furniture member 20 may take other forms, including without limitation, a sofa or a loveseat, for example. Regardless of its form, the furniture member 20 may include a seat base 24, a seat back 26, a mid-ottoman segment 27, a legrest 28, and a footrest 29.

With reference to FIGS. 1A, 1B, and 2, the seat base 24 of the furniture member 20 includes a forward seat base end 30 and a rearward seat base end 32. The seat back 26 of the furniture member 20 includes a pair of seat back sides 33. The furniture member 20 further includes a pair of seat base sides 34, a forward cross-member 35*a* that extends between the seat base sides 34 adjacent to the forward seat base end 30, and a rear cross-member 35*b* that extends between the seat base sides 34 adjacent to the rearward seat base end 32. The forward cross-member 35*a* and the rear cross-member 35*b* are connected to the seat base sides 34, which together form a sub-frame of the furniture member 20 that receives and supports the legrest mechanism(s) 22. The seat back 26 of the furniture member 20 is positioned adjacent to and extends away from the rearward seat base end 32. In operation, the seat back 26 pivots or tilts forward and backwards relative to the seat base 24 and the seat base sides 34 between an upright position and a reclined position. An angle 36 is formed between the seat base 24 and the seat back 26. This angle 36 may be more than, less than, or equal to 90 degrees when the seat back 26 is in the upright position. Accordingly, the term "upright" includes, but is not limited to, orientations where the seat back 26 is substantially vertically oriented. Regardless of what the angle 36 is when the seat back 26 is in the upright position, the angle 36 between the seat base 24 and the seat back 26 will be larger when the seat back 26 is in the reclined position than when the seat back 26 is in the upright position.

The seat base 24 includes a seat base frame 37. The seat back sides 33 and the seat base frame 37 are connected to the legrest mechanism(s) 22. The seat base 24 moves relative to the seat base sides 34 when the seat back 26 moves back and forth between the upright position and the reclined position. In one exemplary embodiment, the seat base 24 moves upwards and rearwards as the seat back 26 moves from the upright position to the reclined position. The forward seat base end 30 rises more than the rearward seat base end 32 relative to the cross-members 35*a,* 35*b* during this motion such that the seat base 24 tilts rearward. The opposite is true for when the seat back 26 moves from the reclined position back to the upright position.

The legrest 28 of the furniture member 20 is positioned adjacent to the forward seat base end 30. In operation, the mid-ottoman segment 27, the legrest 28, and the footrest 29 move relative to the seat base 24 between a retracted position (FIG. 1A and 1B) and an extended position (FIG. 2). In the retracted position, the footrest 29 folds under the seat base 24, the legrest 28 moves to a substantially vertical orientation forming the front of the furniture member 20, and the mid-ottoman segment 27, which has a narrower width than the legrest 28, retracts behind the legrest 28 and is received between the legrest mechanisms 22. In the extended position, the legrest 28 extends away from the forward seat base end 30, the footrest 29 pivots out away from the legrest 28, and the mid-ottoman segment 27 pivots up between the legrest 28 and the forward seat base end 30. It should be appreciated that the seat base 24, the seat back 26, the mid-ottoman segment 27, the legrest 28, and the footrest 29 of the furniture member 20 may be made of a variety of different materials. By way of example and without limitation, the seat base 24, the seat back 26, the mid-ottoman segment 27, the legrest 28, and the footrest 29 of the furniture member 20 may include wood, plastic or metal frames, foam or poly-fill cushions, and fabric or leather coverings. As shown in FIGS. 1A, 1B, and 2, the mid-ottoman segment 27, the legrest 28, and the footrest 29 are supported by a pair of legrest mechanisms 22 that are mounted to the forward and rear cross-members 35*a,* 35*b.*

The furniture member 20 is configured to support an occupant. It should be appreciated that when the occupant sits on the seat base 24 of the furniture member 20, the seat back 26 is configured to support the occupant's back and optionally the occupant's head and neck. When the seat back 26 of the furniture member 20 is in the upright position and the legrest 28 is in the retracted position, the furniture member 20 is configured to provide a traditional seating position with the occupant's feet resting on the floor. When the seat back 26 of the furniture member 20 is in the reclined position and the legrest 28 is in the extended position, the furniture member 20 is configured to support the occupant in a position where the occupant's feet are elevated above the floor. In the extended position, the mid-ottoman segment 27, the legrest 28, and the footrest 29 are configured to support the occupant's legs and feet. For example, the mid-ottoman segment 27 is generally configured to support the upper calves of the occupant, the legrest 28 is generally configured to support the lower calves of the occupant, and the footrest 29 is generally configured to support the occupant's feet. Of course the relationship between these components of the furniture member 20 and the occupant's body parts will vary depending upon the occupant's size and seating position on the furniture member 20.

With additional reference to FIGS. 3-6, each legrest mechanism 22 of the furniture member 20 includes a seat base rail 38, a mechanism rail 40, a seat back pivot assembly 42, a drive assembly 44, and a parallelogram legrest link assembly 46. The seat base rail 38 is mounted to the seat base frame 37. By way of example and without limitation, the seat base rail 38 may be fixedly mounted to the seat base frame 37 using adhesive and/or one or more fasteners such as screws, bolts, nails, staples, rivets, or any combination thereof. The seat base rail 38 is not fixedly mounted to the seat base sides 34 and therefore can move relative the seat base sides 34. The seat base rail 38 has a forward seat base rail end 48 and a rearward seat base rail end 50. The forward seat base rail end 48 is positioned adjacent the forward seat base end 30 and the rearward seat base rail end 50 is positioned adjacent the rearward seat base end 32. The seat base rail 38 has a base portion 52 that extends in a seat base plane 54 and a bent portion 56, adjacent to the rearward seat base rail end 50, that is angled relative to the seat base plane 54. The angle between the bent portion 56 and the base plane 54 may be greater than, less than, or equal to 90 degrees.

The mechanism rail 40 includes a forward mechanism rail end 58 and a rearward mechanism rail end 60. The mechanism rail 40 is mounted to one of the forward cross-member 35*a* and the rear cross-members 35*b.* By way of example and without limitation, the mechanism rail 40 may be fixedly mounted to the cross-members 35*a,* 35*b* using adhesive and/or one or more fasteners such as screws, bolts, nails, staples, rivets, or any combination thereof. The forward mechanism rail 40 is positioned adjacent the forward seat base end 30 and the rearward mechanism rail end 60 is positioned adjacent the rearward seat base end 32. The mechanism rail 40 may be constructed in a variety of different shapes. In one non-limiting example, the mechanism rail 40 may be constructed to have an L-shape cross-section.

The seat back pivot assembly 42 is pivotally connected to the rearward seat base rail end 50 and the rearward mechanism rail end 60. The seat back pivot assembly 42 includes a seat back rail 62 and a seat back rail link 64. The seat back rail 62 is pivotally connected to the rearward seat base rail end 50. The seat back 26 of the furniture member 20 is mounted to and supported by the seat back rail 62. By way of example and without limitation, the seat back 26 may be fixedly mounted to the seat back rail 62 using adhesive and/or one or more fasteners such as screws, bolts, nails, staples, rivets, or any combination thereof. The seat back rail link 64 extends between and is pivotally connected to the seat back rail 62 adjacent to the rearward seat base rail end 50 and the rearward mechanism rail end 60. Although a variety of different configurations are possible, the seat back rail 62 and the seat back rail link 64 may each have a bent profile. It should be appreciated that the term "bent profile," as used herein, refers to a component that extends non-linearly (i.e. a component that isn't straight) when viewed from the side (as shown in FIGS. 3-6).

The drive assembly 44 is pivotally connected to the base portion 52 of the seat base rail 38 and the forward mechanism rail end 58. The drive assembly 44 operates to drive motion of the mechanism rail 40 relative to the seat base rail 38. The drive assembly 44 includes a mechanism rail connection 66, a drive plate 68, a drive link 70, a seat rail connection 72, a linear actuator 74, and an actuation cross-member 75. It should be appreciated that although the drive assembly 44 illustrated in the drawings and described herein includes a linear actuator 74, alternative configurations are possible that utilize other types of powered actuators or mechanical actuators such as handles or levers that are manually operated by the occupant. As such, it should be understood that the scope of the subject disclosure is not limited to electrically powered drive assemblies, but also encompasses other drive assemblies including manual drive assemblies.

The mechanism rail connection 66 of the drive assembly 44 extends from a fixed end 76 that is fixedly attached to the mechanism rail 40 to a free end 78. By way of example and without limitation, the fixed end 76 of the mechanism rail connection 66 may be mounted to the mechanism rail 40 between the forward mechanism rail end 58 and the rearward mechanism rail end 60 using adhesive and/or one or more fasteners such as screws, bolts, staples, rivets, or any combination thereof. Alternatively, the mechanism rail connection 66 may be integral with the mechanism rail 40 itself. The drive plate 68 has a drive attachment end 80, a link attachment end 82, and a medial portion 84 disposed between the drive attachment end 80 and the link attachment end 82. The medial portion 84 of the drive plate 68 is pivotally connected to the mechanism rail connection 66 by a drive plate pivot 86. Although a variety of different configurations are possible, the drive plate 68 may have a bent profile. As shown in FIGS. 1A, 1B, and 2, the linear actuator 74 of the drive assembly 44 is pivotally connected to the drive attachment end 80 of the drive plate 68 by the actuation cross-member 75. The legrest mechanisms 22 are arranged with each drive plate 68 on the inside of the mechanism rail 40 (i.e. the drive plate 68 is one side of the mechanism rail 40 and the seat base side 34 is on the opposite side of the mechanism rail 40). The actuation cross-member 75 extends between the drive plates 68 of the legrest mechanisms 22 to rotatably couple the drive plates 68. The linear actuator 74 extends between and is pivotally coupled to the rear cross-member 35*b* and the actuation cross-member 75.

The seat rail connection 72 is fixedly attached to the seat base rail 38 adjacent the forward seat base rail end 48. By way of example and without limitation, the seat rail connection 72 may be mounted to the seat base rail 38 using adhesive and/or one or more fasteners such as screws, bolts, nails, staples, rivets, or any combination thereof. Alternatively, the seat rail connection 72 may be integral with the seat base rail 38 itself. The drive link 70 of the drive assembly 44 extends between and is pivotally connected to the seat rail connection 72 and the link attachment end 82 of the drive plate 68. Although a variety of different configurations are possible, the drive link 70 may have a straight profile (i.e. linear profile) when viewed from the side (as shown in FIGS. 3-6).

Each legrest mechanism 22 includes a pivot plate link 88 and a pivot plate 90. The pivot plate link 88 is pivotally connected to the base portion 52 of the seat base rail 38 adjacent to the bent portion 56 of the seat base rail 38. The pivot plate 90 extends between a forward pivot plate end 92 that is pivotally connected to the forward mechanism rail end 58 and a rearward pivot plate end 94 that is pivotally connected to the pivot plate link 88. Each legrest mechanism 22 also includes a full recline link 96, a back recline link 98, a slotted link 100, and a main drive link 102. The full recline link 96 is pivotally connected to the base portion 52 of the seat base rail 38 adjacent to the seat rail connection 72. Although a variety of different configurations are possible, the full recline link 96 may have a bent profile. The back recline link 98 extends between, and is pivotally connected to, the rearward mechanism rail end 60 and the full recline link 96. Although a variety of different configurations are possible, the back recline link 98 may have a straight profile.

The slotted link 100 of each legrest mechanism 22 is pivotally connected to the full recline link 96. The slotted link 100 includes a straight slot 104. The straight slot 104 extends linearly meaning that the straight slot 104 is not bent or curved. The mechanism rail 40 includes a mechanism rail pin 106. The mechanism rail pin 106 extends from the forward mechanism rail end 58 and is slidingly received in the straight slot 104 of the slotted link 100. Accordingly, the mechanism rail pin 106 couples the slotted link 100 to the mechanism rail 40. The main drive link 102 extends between a main drive link proximal end 108 and a main drive link distal end 110. The main drive link proximal end 108 is pivotally connected to the pivot plate 90 between the forward pivot plate end 92 and the rearward pivot plate end 94.

The parallelogram legrest link assembly 46 of the furniture member 20 is pivotally connected to the forward seat base rail end 48 and the main drive link distal end 110. During normal operation, the parallelogram legrest link assembly 46 moves between the retracted position and the extended position in response to relative movement between the mechanism rail 40 and the seat base rail 38, which is driven by the linear actuator 74 of the drive assembly 44. The parallelogram legrest link assembly 46 includes a first legrest link 112, a second legrest link 114, a footrest drive arm 116, a legrest drive arm 118, a mid-ottoman bracket arm 120, a legrest bracket 122, a footrest pivot link 124, and a footrest bracket arm 126.

The first legrest link 112 of the parallelogram legrest link assembly 46 extends between a first legrest link proximal end 128 and a first legrest link distal end 130. The first legrest link proximal end 128 is pivotally connected to the forward seat base rail end 48 by a first pivot 132. The second legrest link 114 extends between a second legrest link proximal end 134 and a second legrest link distal end 136. The second legrest link proximal end 134 is pivotally connected to the base portion 52 of the seat base rail 38 by a second pivot 138 positioned between the forward seat base rail end 48 and the full recline link 96. Although a variety of different configurations are possible, the first and second legrest links 112, 114 may each have a bent profile.

The footrest drive arm 116 of the parallelogram legrest link assembly 46 extends between a footrest drive arm proximal end 140 and a footrest drive arm distal end 142. The footrest drive arm proximal end 140 is pivotally connected to the first legrest link distal end 130. The legrest drive arm 118 extends between a legrest drive arm proximal end 144 and a legrest drive arm distal end 146. The legrest drive arm proximal end 144 is pivotally connected to the second legrest link distal end 136. Accordingly, the first legrest link 112 extends between and is pivotally connected to the seat base rail 38 and the footrest drive arm 116. The second legrest link 114 extends between and is pivotally connected to the seat base rail 38 and the legrest drive arm 118. Although a variety of different configurations are possible, the footrest drive arm 116 and the legrest drive arm 118 may each have a bent profile. The mid-ottoman bracket arm 120 is pivotally connected to the footrest drive arm 116 between the footrest drive arm proximal end 140 and the footrest drive arm distal end 142 and pivotally connected to the legrest drive arm 118 between the legrest drive arm proximal end 144 and the legrest drive arm distal end 146. The mid-ottoman bracket arm 120 includes a mid-ottoman bracket 148. The mid-ottoman bracket 148 is fixedly connected to and supports the mid-ottoman segment 27 of the furniture member 20. By way of example and without limitation, the mid-ottoman segment 27 may be mounted to the mid-ottoman bracket 148 of the mid-ottoman bracket arm 120 using adhesive and/or one or more fasteners such as screws, bolts, nails, staples, rivets, or any combination thereof.

The legrest bracket 122 of the parallelogram legrest link assembly 46 is pivotally connected to the footrest drive arm distal end 142 and the legrest drive arm distal end 146. Accordingly, the footrest drive arm 116 extends between and is pivotally connected to the first legrest link 112 and the legrest bracket 122. The legrest drive arm 118 extends between and is pivotally connected to the second legrest link 114 and the legrest bracket 122. The legrest bracket 122 is fixedly connected to and supports the legrest 28. By way of example and without limitation, the legrest 28 may be mounted to the legrest bracket 122 using adhesive and/or one or more fasteners such as screws, bolts, nails, staples, rivets, or any combination thereof. The footrest pivot link 124 extends between a footrest pivot link proximal end 150 and a footrest pivot link distal end 152. The footrest pivot link proximal end 150 is pivotally connected to the legrest drive arm 118 between the legrest drive arm proximal end 144 and the legrest drive arm distal end 146. The footrest bracket arm 126 is pivotally connected to the legrest bracket 122 and the footrest pivot link distal end 152. Accordingly, the footrest pivot link 124 extends between and is pivotally connected to the legrest drive arm 118 and the footrest bracket arm 126. The footrest bracket arm 126 includes a footrest bracket 154. The footrest bracket 154 is fixedly connected to and supports the footrest 29. By way of example and without limitation, the footrest 29 may be mounted to the footrest bracket 154 of the footrest bracket arm 126 using adhesive and/or one or more fasteners such as screws, bolts, nails, staples, rivets, or any combination thereof.

Figure 7:
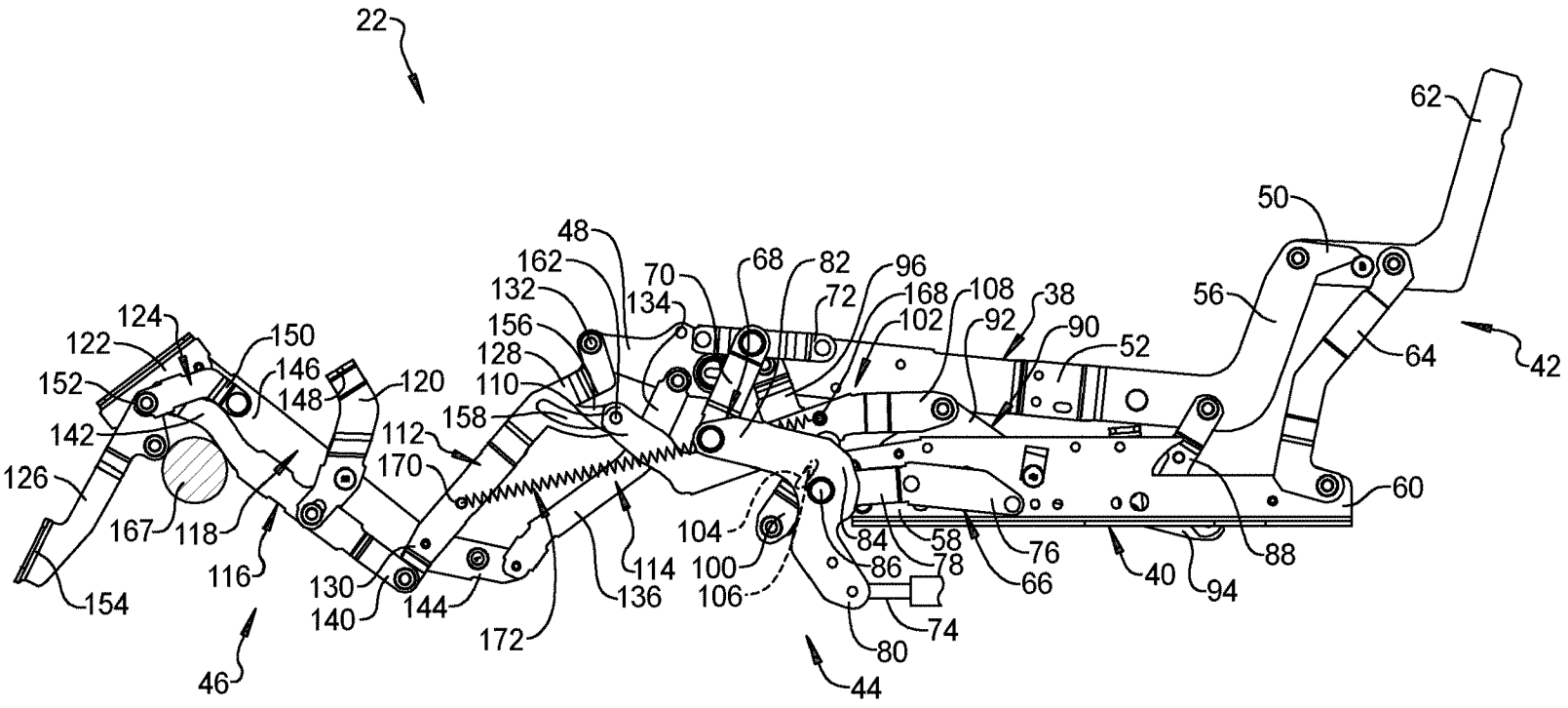
FIG. 7 is a side elevation view of the exemplary legrest mechanism illustrated in FIG. 3 where the legrest mechanism has encountered an obstruction when moving between the retracted position and the extended position.
Figure 8:
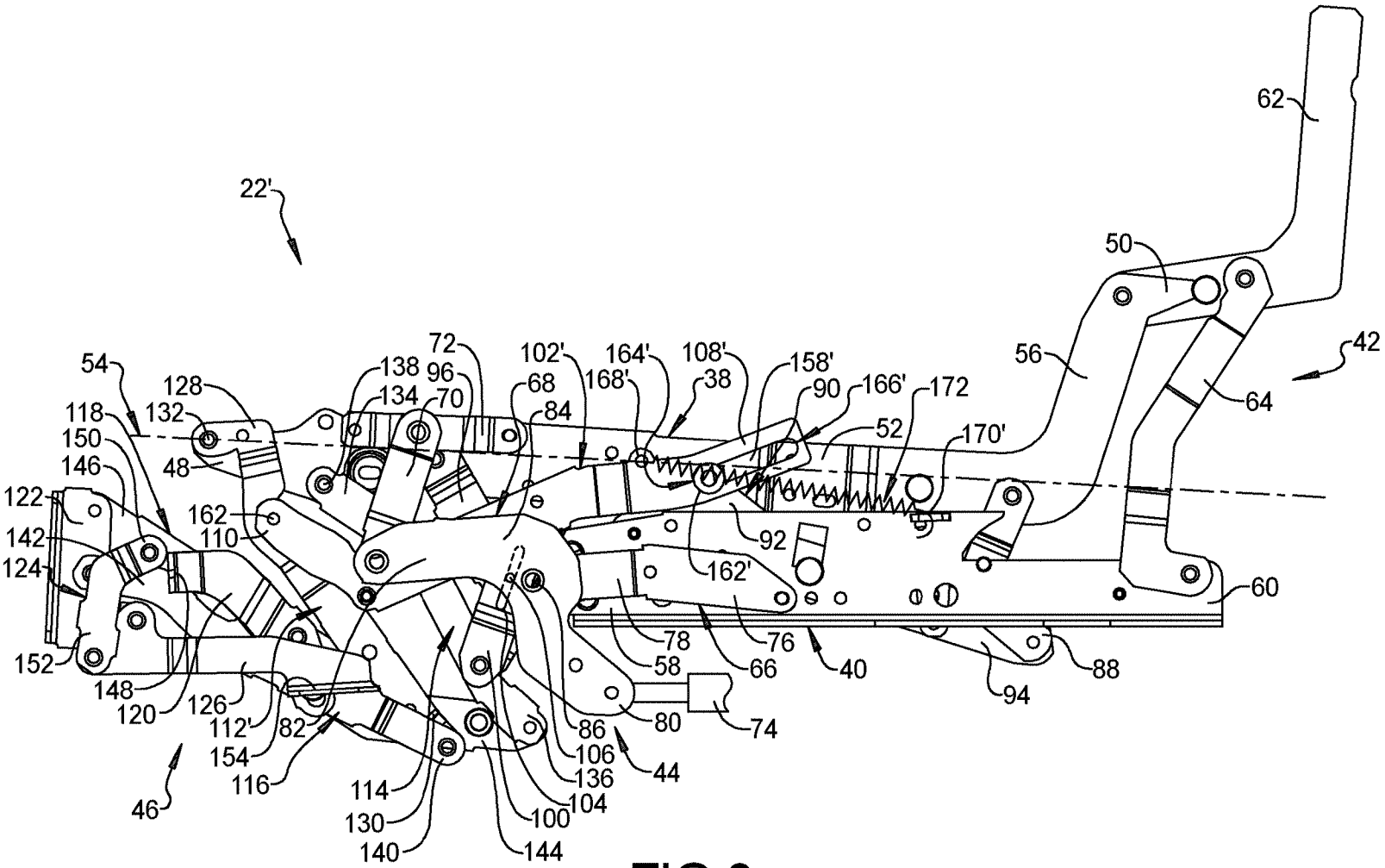
FIG. 8 is a side elevation view of another exemplary legrest mechanism constructed in accordance with the subject disclosure where the legrest mechanism is shown in the retracted position.
Figure 9:
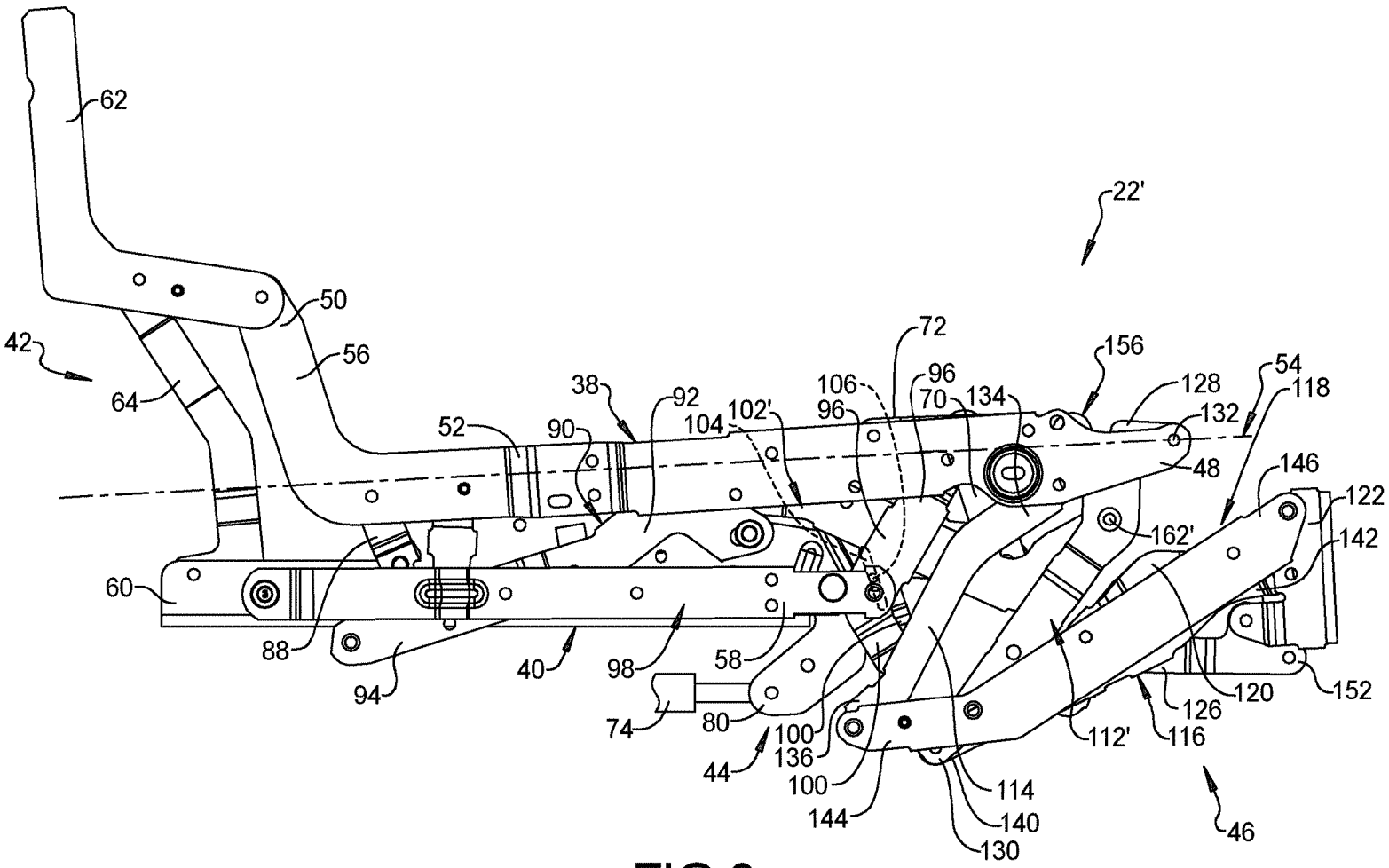
FIG. 9 is a side elevation view of the exemplary legrest mechanism illustrated in FIG. 8 where an opposite side of the legrest mechanism is shown in the retracted position.
Figure 10:
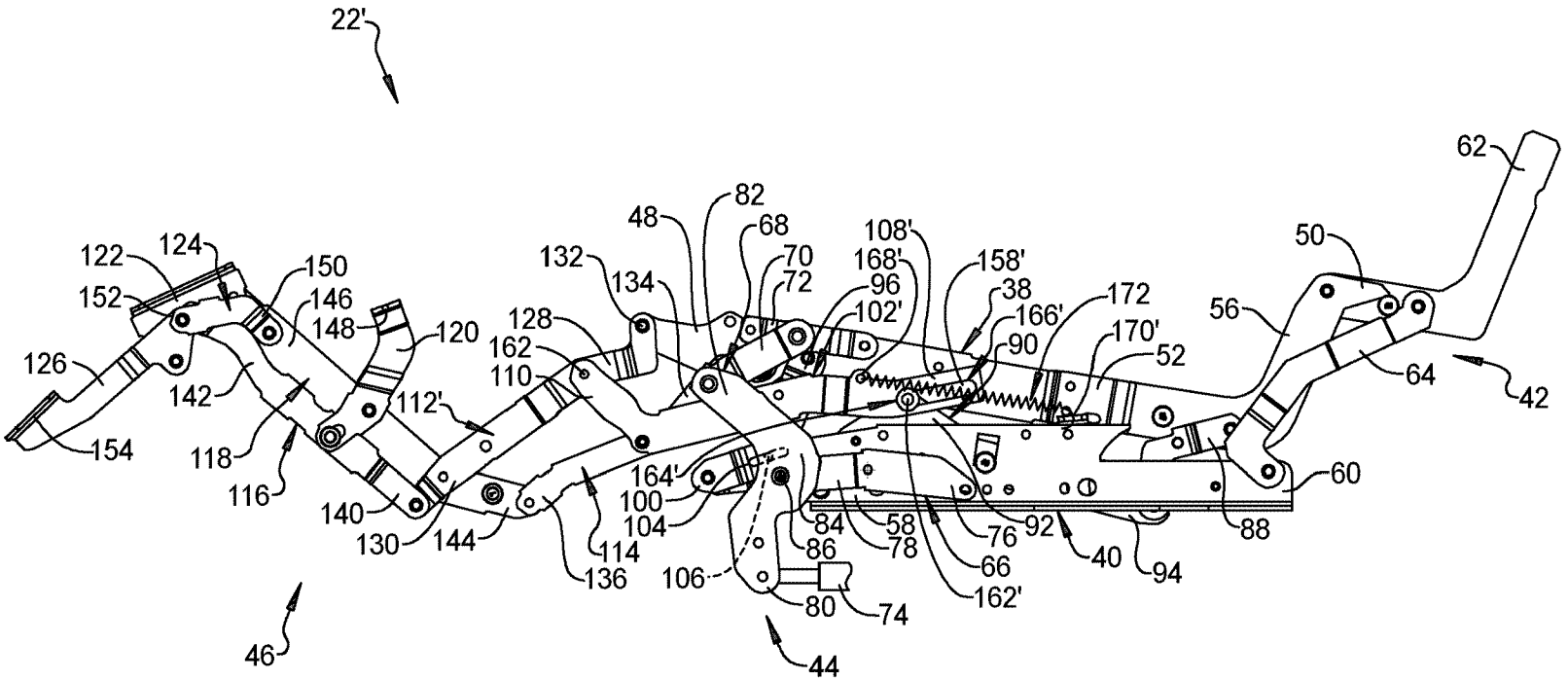
FIG. 10 is a side elevation view of the exemplary legrest mechanism illustrated in FIG. 8 where the legrest mechanism is shown moving between the retracted position and the extended position.
Figure 11:
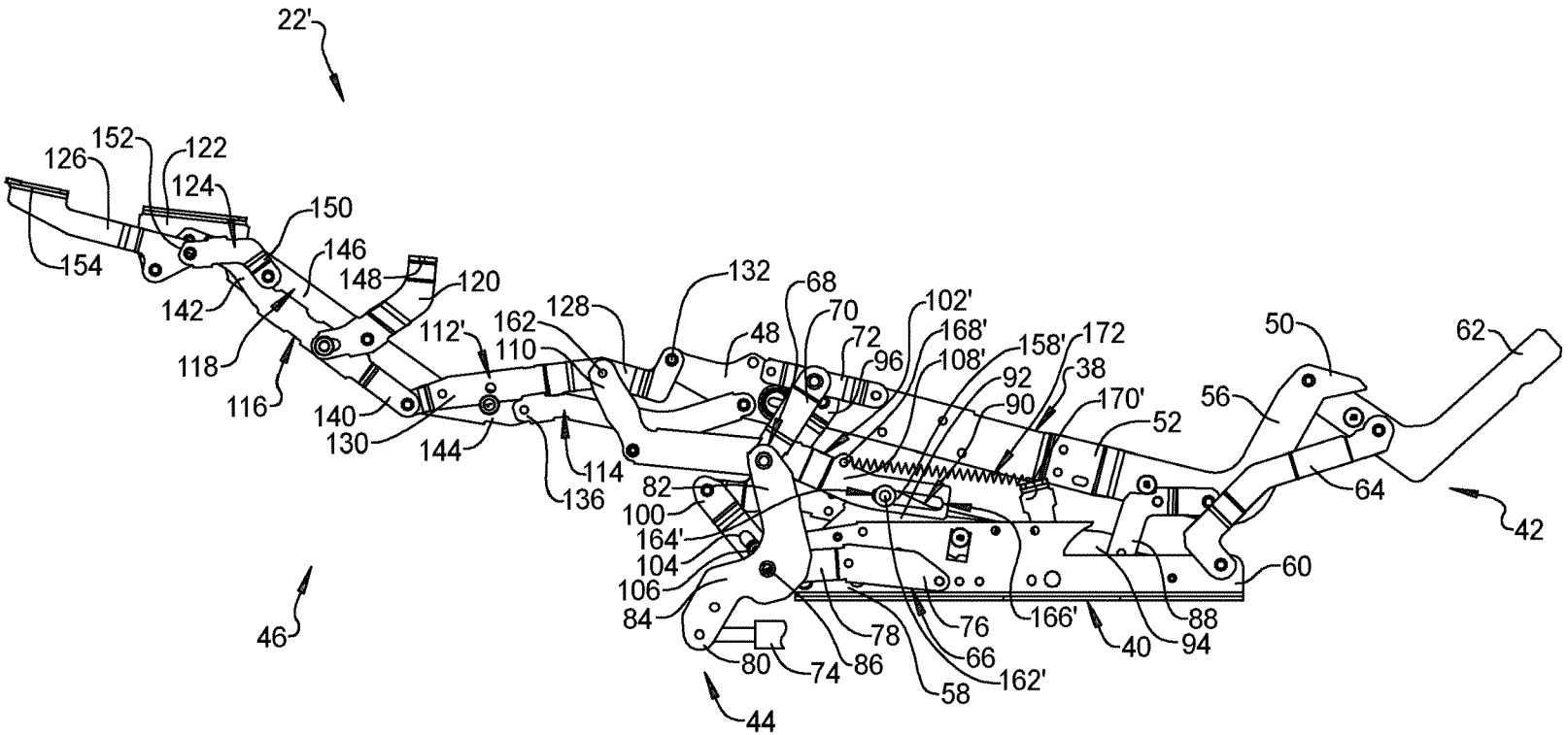
FIG. 11 is a side elevation view of the exemplary legrest mechanism illustrated in FIG. 8 where the legrest mechanism is shown in the extended position.

In operation, the linear actuator 74 of the drive assembly 44 drives movement of the drive attachment end 80 of the drive plate 68 towards or away from the mechanism rail connection 66. When the linear actuator 74 drives the drive attachment end 80 of the drive plate 68 away from the mechanism rail connection 66 (i.e. in a clockwise direction about the drive plate pivot 86 when viewed from the side as shown in FIGS. 3-6), the legrest 28 moves towards the extended position. When the linear actuator 74 drives the drive attachment end 80 of the drive plate 68 toward the mechanism rail connection 66 (i.e. in a counter-clockwise direction about the drive plate pivot 86 when viewed from the side as shown in FIGS. 3-6), the legrest 28 moves towards the retracted position unless the legrest 28 or the parallelogram legrest link assembly 46 encounters an obstruction 167 (FIG. 7). Rotation of the drive plate 68 in the clockwise direction pivots the drive link 70 in the clockwise direction, which causes the seat base rail 38 to pivot backwards and down so that the rearward seat base rail end 50 moves towards the rearward mechanism rail end 60. As part of this motion of the seat base rail 38 relative to the mechanism rail 40, the seat back rail link 64 and the pivot plate link 88 rotate in the clockwise direction. The movement of the seat base rail 38 relative to the mechanism rail 40 causes the first and second legrest links 112, 114 to pivot out and away from the seal base rail in the clockwise direction, which causes the footrest drive arm 116 and the legrest drive arm 118 to pivot out away from the first and second legrest links 112, 114 in the counter-clockwise direction. This movement of the footrest drive arm 116 and the legrest drive arm 118 causes the mid-ottoman bracket arm 120 and the legrest bracket 122 to rotate in the clockwise direction. Finally, rotation of the legrest bracket 122 in the clockwise direction causes the footrest bracket arm 126 to pivot out away from the footrest drive arm 116 in the clockwise direction. Overall, this motion of the legrest mechanism 22 causes the legrest 28 to pivot and unfold from the retracted position to the extended position. This motion is reversed when the legrest 28 is driven from the extended position to the retracted position.

In accordance with one exemplary embodiment shown in FIGS. 3-7, one of the first and second legrest links 112, 114 has a slotted projection 156 with a slot 158 that is curved. In FIGS. 3-7, the slotted projection 156 extends from the first legrest link 112 at a location between the first legrest link proximal end 128 and the first legrest link distal end 130, but adjacent to the first legrest link proximal end 128. However, it should be appreciated that the slotted projection 156 could alternatively extend from the second legrest link 114 at a location between the second legrest link proximal end 134 and the second legrest link distal end 136. In the configuration where the slotted projection 156 extends from the first legrest link 112 (FIGS. 3-7), the slot 158 has a constant radius of curvature 160 measured relative to the first pivot 132. Accordingly, every point along the slot 158 is equidistant from the first pivot 132. In the configuration where the slotted projection 156 extends from the second legrest link 114 (not shown), the slot 158 has a constant radius of curvature 160 measured relative to the second pivot 138. Accordingly, every point along the slot 158 is equidistant from the second pivot 138.

The main drive link 102 has a main drive link pin 162 that extends from the main drive link distal end 110. The main drive link pin 162 is slidingly received in the slot 158 of the slotted projection 156. Due to the arrangement of the slot 158 and the main drive link pin 162, movement of the parallelogram legrest link assembly 46 is decoupled from movement of the main drive link 102 when the legrest 28 or the parallelogram legrest link assembly 46 encounters an obstruction 167 (FIG. 7) while moving from the extended position to the retracted position.

The slot 158 of the slotted projection 156 includes a proximal slot end 164 and a distal slot end 166. As shown in FIGS. 3-6, the main drive link pin 162 contacts the proximal slot end 164 when the main drive link 102 drives the parallelogram legrest link assembly 46 to the extended position. As shown in FIG. 7, the main drive link pin 162 slides in the slot 158 from the proximal slot end 164 towards the distal slot end 166 when the parallelogram legrest link assembly 46 encounters the obstruction 167 while moving from the extended position to the retracted position. Counter-clockwise rotation of the drive link 68, which would normally drive the parallelogram legrest link assembly 46 to the retracted position, causes the pivot plate 90 and the main drive link 102 to travel rearward towards the rearward mechanism rail end 60 when the obstruction 167 restricts movement of the parallelogram legrest link assembly 46 toward the retracted position. This rearward movement of the main drive link 102 causes the main drive link pin 162 to slide towards distal slot end 166. Advantageously, this arrangement solves the problem associated with objects obstructing the parallelogram legrest link assembly 46 as the parallelogram legrest link assembly 46 moves from the extended position to the retracted position and provides a compliant parallelogram legrest link assembly 46. Durability is improved because the compliance provided by the arrangement of the slot 158 and the main drive link pin 162 can prevent the legrest mechanism 22 or other components of the furniture member 20 from binding, bending, or breaking in response to the legrest 28 or the parallelogram legrest link assembly 46 encountering the obstruction 167. The advantages provided by this design are particularly beneficial when the parallelogram legrest link assembly 46 is actuated by a linear actuator 74 due to the higher forces that such drive assemblies can be capable of exerting on the parallelogram legrest link assembly 46. However, the advantages noted herein are still beneficial when the drive assembly is manually actuated.

The main drive link 102 has a first biasing member attachment point 168 and one of the first and second legrest links 112, 114 has a second biasing member attachment point 170. The parallelogram legrest link assembly 46 further includes a biasing member 172 that extends between and is pivotally connected to the first and second biasing member attachment points 168, 170. The biasing member 172 operates to apply a biasing force to the parallelogram legrest link assembly 46 that biases the parallelogram legrest link assembly 46 towards the retracted position. Return of the parallelogram legrest link assembly 46 to the retracted position is driven by the biasing force of the biasing member 172. Accordingly, the maximum force that can be applied to the obstruction 167 by the parallelogram legrest link assembly 46 is the biasing force of the biasing member 172 because once the biasing force is supported by the obstruction 167, the main drive link pin 162 will begin to slide in the slot 158 from the proximal slot end 164 towards the distal slot end 166 and the parallelogram legrest link assembly 46 will stop moving towards the retracted position even if the drive plate 68 of the drive assembly 44 continues to rotate in the counter-clockwise direction about the drive plate pivot 86.

Although other configurations are possible, in the illustrated example, the first biasing member attachment point 168 is positioned along the main drive link 102 at a location between the main drive link proximal end 108 and the main drive link distal end 110. The second biasing member attachment point 170 is positioned along the first legrest link 112 at a location between the first legrest link proximal end 128 and the first legrest link distal end 130. Alternatively, the second biasing member attachment point 170 may be positioned along the second legrest link 114 at a location between the second legrest link proximal end 134 and the second legrest link distal end 136. The biasing member 172 is a tension spring. As a result, the biasing member 172 is stretched between the first and second biasing member attachment points 168, 170 and the biasing force that the biasing member 172 applies to each of the first and second biasing member attachment points 168, 170 points inwardly towards the opposite attachment point. The biasing member 172 may take a variety of different forms and configurations. In one non-limiting example, the biasing member 172 may be a metal coil spring.

In accordance with another exemplary embodiment shown in FIGS. 8-12, the main drive link 102 has been replaced with a main drive link 102' that includes a slot 158' that is straight. The slot 158' extends within the main drive link 102' a location adjacent to the main drive link proximal end 108'. The main drive link 102' has a main drive link pin 162' that extends from the main drive link proximal end 108'. The main drive link pin 162' is slidingly received in the slot 158'. Due to the arrangement of the slot 158' and the main drive link pin 162', movement of the parallelogram legrest link assembly 46 is decoupled from movement of the main drive link 102' when the legrest 28 or the parallelogram legrest link assembly 46 encounters an obstruction 167 (FIG. 12) while moving from the extended position to the retracted position.

Figure 12:
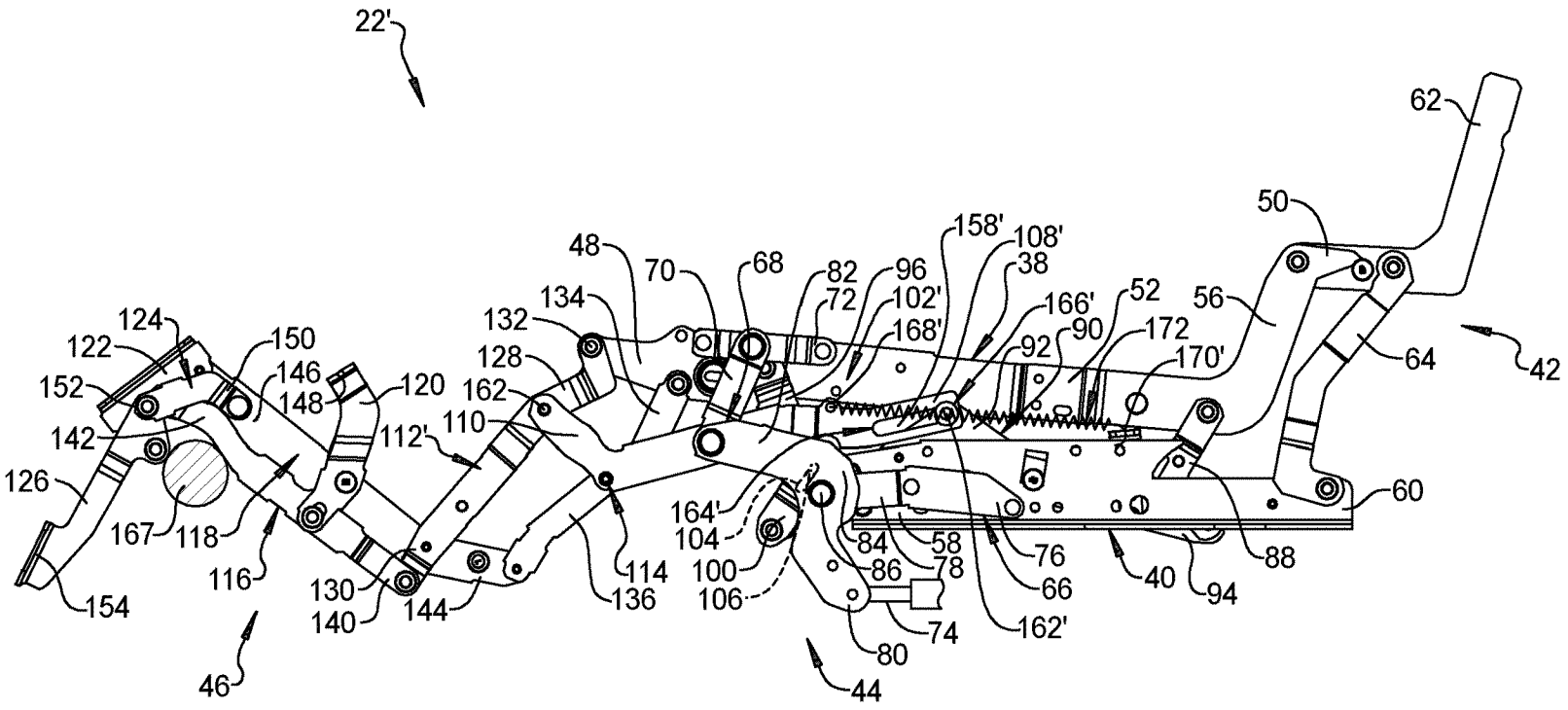
FIG. 12 is a side elevation view of the exemplary legrest mechanism illustrated in FIG. 8 where the legrest mechanism has encountered an obstruction when moving between the retracted position and the extended position.

The slot 158' of the slotted projection 156 includes a proximal slot end 164' and a distal slot end 166'. As shown in FIGS. 8-12, the main drive link pin 162' contacts the proximal slot end 164' when the main drive link 102' drives the parallelogram legrest link assembly 46 to the extended position. As shown in FIG. 12, the main drive link pin 162' slides in the slot 158' from the proximal slot end 164' towards the distal slot end 166' when the parallelogram legrest link assembly 46 encounters the obstruction 167 while moving from the extended position to the retracted position. Counter-clockwise rotation of the drive link 68, which would normally drive the parallelogram legrest link assembly 46 to the retracted position, causes the pivot plate 90 and the main drive link 102' to travel rearward towards the rearward mechanism rail end 60 when the obstruction 167 restricts movement of the parallelogram legrest link assembly 46 toward the retracted position. This rearward movement of the main drive link 102' causes the main drive link pin 162' to slide towards distal slot end 166'. Advantageously, this arrangement solves the problem associated with objects obstructing the parallelogram legrest link assembly 46 as the parallelogram legrest link assembly 46 moves from the extended position to the retracted position and provides a compliant parallelogram legrest link assembly 46. Durability is improved because the compliance provided by the arrangement of the slot 158' and the main drive link pin 162' can prevent the legrest mechanism 22' or other components of the furniture member 20 from binding, bending, or breaking in response to the legrest 28 or the parallelogram legrest link assembly 46 encountering the obstruction 167. The advantages provided by this design is also particularly beneficial when the parallelogram legrest link assembly 46 is actuated by a linear actuator 74 due to the higher forces that such drive assemblies can be capable of exerting on the parallelogram legrest link assembly 46. However, the advantages noted herein are still beneficial when the drive assembly is manually actuated.

In accordance with the embodiment illustrated in FIGS. 8-12, the main drive link 102' has a first biasing member attachment point 168' and a second biasing member attachment point 170' is provided in the form of a link that is pivotally connected to the mechanism rail 40. The second biasing member attachment point 170' may alternatively be located on the seat base rail 38 or the seat base 24. The biasing member 172 extends between and is pivotally connected to the first and second biasing member attachment points 168', 170'. The biasing member 172 operates to apply a biasing force to the parallelogram legrest link assembly 46 that biases the parallelogram legrest link assembly 46 towards the retracted position. Return of the parallelogram legrest link assembly 46 to the retracted position is driven by the biasing force of the biasing member 172. Accordingly, the maximum force that can be applied to the obstruction 167 by the parallelogram legrest link assembly 46 is the biasing force of the biasing member 172 because once the biasing force is supported by the obstruction 167, the main drive link pin 162' will begin to slide in the slot 158' from the proximal slot end 164' towards the distal slot end 166' and the parallelogram legrest link assembly 46 will stop moving towards the retracted position even if the drive plate 68 of the drive assembly 44 continues to rotate in the counter-clockwise direction about the drive plate pivot 86.

Although other configurations are possible, in the illustrated example, the first biasing member attachment point 168' is positioned along the main drive link 102' at a location between the main drive link proximal end 108' and the main drive link distal end 110'. The second biasing member attachment point 170' is positioned along the mechanism rail 40 at a location between the distal slot end 166' and the rearward mechanism rail end 60. If the second biasing member attachment point 170' is located on the seat base rail 38 or the seat base 24, the second biasing member attachment point 170' can be located somewhere near the rearward seat base end 32. The biasing member 172 is a tension spring. As a result, the biasing member 172 is stretched between the first and second biasing member attachment points 168', 170' and the biasing force that the biasing member 172 applies to each of the first and second biasing member attachment points 168', 170' points inwardly towards the opposite attachment point. The biasing member 172 may take a variety of different forms and configurations. In one non-limiting example, the biasing member 172 may be a metal coil spring.

It should be appreciated that a wide variety of different materials can be chosen for the various components of the legrest mechanism 22 and furniture member 20. By way of example and without limitation, the various components of the legrest mechanism 22 and furniture member 20 may be made of metal, wood, plastic, and combinations thereof. Where components of the legrest mechanism 22 and furniture member 20 have been described as pivotally connected, that means that the components are connected in a manner that permits relative rotation of the components about a pivot point. It should be appreciated that such pivot connections between components may be provided in various forms, including without limitation, through the use of pivots that may or may not include one or more bushings.

Many modifications and variations of the present disclosure are possible in light of the above teachings and may be practiced otherwise than as specifically described while within the scope of the appended claims. These antecedent recitations should be interpreted to cover any combination in which the inventive novelty exercises its utility.

What is claimed is:

1. A legrest mechanism for a furniture member comprising:

a seat base rail;

a mechanism rail;

a drive assembly pivotally connected to said seat base rail and said mechanism rail that operates to drive motion of said mechanism rail relative to said seat base rail;

a pivot plate link pivotally connected to said seat base rail;

a pivot plate pivotally connected to said mechanism rail and said pivot plate link;

a main drive link pivotally connected to said pivot plate;

a parallelogram legrest link assembly pivotally connected to said seat base rail and said main drive link that is moveable between a retracted position and an extended position in response to relative movement between said mechanism rail and said seat base rail;

said parallelogram legrest link assembly including a first legrest link, a second legrest link, a footrest drive arm, a legrest drive arm, and a legrest bracket, said first legrest link extending between and pivotally connected to said seat base rail and said footrest drive arm, said second legrest link extending between and pivotally connected to said seat base rail and said legrest drive arm, said footrest drive arm extending between and pivotally connected to said first legrest link and said legrest bracket, said legrest drive arm extending between and pivotally connected to said second legrest link and said legrest bracket; and one of said first legrest link, said second legrest link, and said main drive link having a first slot and said main drive link having a main drive link pin that is slidingly received in said first slot such that movement of said parallelogram legrest link assembly is decoupled from movement of said main drive link when said parallelogram legrest link assembly encounters an obstruction while moving from said extended position to said retracted position, wherein said main drive link pin maintains its position along a length of said first slot while said main drive link drives said parallelogram legrest link assembly from said retracted position to said extended position.

2. The legrest mechanism as set forth in claim 1 wherein said first slot includes a proximal slot end and a distal slot end, said main drive link pin contacts said proximal slot end when said main drive link drives said parallelogram legrest link assembly to said extended position, and said main drive link pin slides in said first slot from said proximal slot end towards said distal slot end when said parallelogram legrest link assembly encounters the obstruction while moving from said extended position to said retracted position.

3. The legrest mechanism as set forth in claim 2 wherein said main drive link has a first biasing member attachment point, one of said first and second legrest links has a second biasing member attachment point, and said parallelogram legrest link assembly includes a biasing member extending between and connected to said first and second attachment points for biasing said parallelogram legrest link assembly towards said retracted position.

4. The legrest mechanism as set forth in claim 3 wherein said first legrest link has a slotted projection that extends from said first legrest link and includes said first slot and wherein said main drive link pin that is slidingly received in said first slot pivotally connects said main drive link to said first legrest link.

5. The legrest mechanism as set forth in claim 4 wherein said first legrest link is pivotally connected to said seat base rail by a first pivot and wherein said first slot is curved and has a constant radius of curvature measured relative to said first pivot.

6. The legrest mechanism as set forth in claim 3 wherein said second legrest link has a slotted projection that extends from said second legrest link and includes said first slot and wherein said main drive link pin that is slidingly received in said first slot pivotally connects said main drive link to said second legrest link.

7. The legrest mechanism as set forth in claim 6 wherein said second legrest link is pivotally connected to said seat base rail by a second pivot and wherein said first slot is curved and has a constant radius of curvature measured relative to said second pivot.

8. The legrest mechanism as set forth in claim 2 wherein said main drive link has a first biasing member attachment point, one of said seat base rail and said mechanism rail has a second biasing member attachment point, and said parallelogram legrest link assembly includes a biasing member extending between and connected to said first and second attachment points for biasing said parallelogram legrest link assembly towards said retracted position.

9. The legrest mechanism as set forth in claim 8 wherein said first slot is formed in said main drive link and wherein said main drive link pin that is slidingly received in said first slot pivotally connects said main drive link to said pivot plate.

10. The legrest mechanism as set forth in claim 1, further comprising:

a full recline link pivotally connected to said seat base rail;

a back recline link extending between and pivotally connected to said mechanism rail and said full recline link;

a slotted link pivotally connected to said full recline link, said slotted link including a second slot; and a mechanism rail pin extending from said forward mechanism rail end that is slidingly received in said second slot of said slotted link to couple said slotted link to said mechanism rail.

11. A furniture member comprising:

a seat base including a forward seat base end, a rearward seat base end, and a pair of seat base sides that extend between said forward seat base end and said rearward seat base end;

a seat back positioned adjacent to and extending away from said rearward seat base end that pivots relative to said seat base between an upright position and a reclined position;

a legrest adjacent to said forward seat base end that moves relative to said seat base between a retracted position and an extended position; and a pair of legrest mechanisms mounted to said pair of seat base sides, each of said legrest mechanisms including:

a seat base rail;

a mechanism rail;

a drive assembly pivotally connected to said seat base rail and said mechanism rail that operates to drive motion of said mechanism rail relative to said seat base rail;

a pivot plate link pivotally connected to said seat base rail;

a pivot plate pivotally connected to said mechanism rail and said pivot plate link;

a main drive link pivotally connected to said pivot plate;

a parallelogram legrest link assembly pivotally connected to said seat base rail and said main drive link that is moveable between said retracted position and said extended position in response to relative movement between said mechanism rail and said seat base rail;

said parallelogram legrest link assembly including a first legrest link, a second legrest link, a footrest drive arm, a legrest drive arm, and a legrest bracket, said first legrest link extending between and pivotally connected to said seat base rail and said footrest drive arm, said second legrest link extending between and pivotally connected to said seat base rail and said legrest drive arm, said footrest drive arm extending between and pivotally connected to said first legrest link and said legrest bracket, said legrest drive arm extending between and pivotally connected to said second legrest link and said legrest bracket; and one of said first legrest link, said second legrest link, and said main drive link having a first slot and said main drive link having a main drive link pin that is slidingly received in said first slot such that movement of said parallelogram legrest link assembly is decoupled from movement of said main drive link when said legrest encounters an obstruction while moving from said extended position to said retracted position.

12. The furniture member as set forth in claim 11 wherein said first slot includes a proximal slot end and a distal slot end, said main drive link pin contacts said proximal slot end when said main drive link drives said parallelogram legrest link assembly to said extended position, and said main drive link pin slides in said first slot from said proximal slot end towards said distal slot end when said parallelogram legrest link assembly encounters the obstruction while moving from said extended position to said retracted position.

13. The furniture member as set forth in claim 12 wherein said main drive link has a first biasing member attachment point, one of said first and second legrest links has a second biasing member attachment point, and said parallelogram legrest link assembly includes a biasing member extending between and connected to said first and second attachment points for biasing said parallelogram legrest link assembly towards said retracted position.

14. The furniture member as set forth in claim 13 wherein said first legrest link has a slotted projection that extends from said first legrest link and includes said first slot and wherein said main drive link pin that is slidingly received in said first slot pivotally connects said main drive link to said first legrest link.

15. The furniture member as set forth in claim 14 wherein said first legrest link is pivotally connected to said seat base rail by a first pivot and wherein said first slot is curved and has a constant radius of curvature measured relative to said first pivot.

16. The furniture member as set forth in claim 13 wherein said second legrest link has a slotted projection that extends from said second legrest link and includes said first slot and wherein said main drive link pin that is slidingly received in said first slot pivotally connects said main drive link to said second legrest link.

17. The furniture member as set forth in claim 16 wherein said second legrest link is pivotally connected to said seat base rail by a second pivot and wherein said first slot is curved and has a constant radius of curvature measured relative to said second pivot.

18. The furniture member as set forth in claim 12 wherein said main drive link has a first biasing member attachment point, one of said seat base, said seat base rail, and said mechanism rail has a second biasing member attachment point, and said parallelogram legrest link assembly includes a biasing member extending between and connected to said first and second attachment points for biasing said parallelogram legrest link assembly towards said retracted position.

19. The furniture member as set forth in claim 18 wherein said first slot is formed in said main drive link and wherein said main drive link pin that is slidingly received in said first slot pivotally connects said main drive link to said pivot plate.

20. The furniture member as set forth in claim 11, further comprising:

a full recline link pivotally connected to said seat base rail;

a back recline link extending between and pivotally connected to said mechanism rail and said full recline link;

a slotted link pivotally connected to said full recline link, said slotted link including a second slot; and a mechanism rail pin extending from said forward mechanism rail end that is slidingly received in said second slot of said slotted link to couple said slotted link to said mechanism rail.

21. The furniture member as set forth in claim 11 wherein said parallelogram legrest link assembly further includes a mid-ottoman bracket arm pivotally connected to said footrest drive arm and said legrest drive arm, said mid-ottoman bracket arm having a mid-ottoman bracket that is connected to and supports at least part of said legrest.

22. The furniture member as set forth in claim 11 wherein said parallelogram legrest link assembly further includes a footrest bracket arm pivotally connected to said legrest bracket and a footrest pivot link extending between and pivotally connected to said legrest drive arm and said footrest bracket arm, said footrest bracket arm having a footrest bracket that is connected to and supports at least part of said legrest.

* * * * *